US012635799B2

(12) United States Patent
Peng et al.

(10) Patent No.: US 12,635,799 B2
(45) Date of Patent: May 26, 2026

(54) CHAIR BACKREST FOLDING LOCKING MECHANISM AND FOLDING CHAIR

(71) Applicant: Zhejiang Yueqiang Furniture Technology Co., Ltd, Huzhou (CN)

(72) Inventors: Hanqiang Peng, Huzhou (CN); Weihong Peng, Huzhou (CN)

(73) Assignee: ZHEJIANG YUEQIANG FURNITURE TECHNOLOGY CO., LTD, Huzhou (CN)

( * ) Notice: Subject to any disclaimer, the term of this patent is extended or adjusted under 35 U.S.C. 154(b) by 156 days.

(21) Appl. No.: 18/761,323

(22) Filed: Jul. 2, 2024

(65) Prior Publication Data

US 2025/0194804 A1 Jun. 19, 2025

(30) Foreign Application Priority Data

Dec. 14, 2023 (CN) ..... 202323414231.0

(51) Int. Cl.
*A47C 7/40* (2006.01)

(52) U.S. Cl.
CPC ..... *A47C 7/407* (2013.01)

(58) Field of Classification Search
CPC ..... A47C 7/407; B60N 2/206
USPC ..... 297/378.12, 378.1, 378.11, 378.13, 297/378.14
See application file for complete search history.

(56) References Cited

U.S. PATENT DOCUMENTS

| | | | | |
|---|---|---|---|---|
| 6,685,266 | B2 * | 2/2004 | James | B60N 2/286 297/378.12 |
| 7,661,760 | B2 * | 2/2010 | Nakaya | B60N 2/3065 297/378.12 |
| 7,699,398 | B2 * | 4/2010 | Sokolla | B60N 2/366 297/378.13 |
| 8,550,560 | B2 * | 10/2013 | Moriyama | B60N 2/2231 297/378.12 |
| 11,617,443 | B1 * | 4/2023 | Levin | A47C 7/407 297/378.1 |
| 2010/0207440 | A1 * | 8/2010 | Hayakawa | B60N 2/12 297/378.14 |
| 2013/0082501 | A1 * | 4/2013 | Hung | A47C 7/407 297/354.1 |

* cited by examiner

*Primary Examiner* — Alfred J Wujciak

(57) ABSTRACT

A chair backrest folding locking mechanism is provided, which includes a fixing bracket, defining a locking hole disposed transversely; a chair backrest, hinged with the fixing bracket; a transverse locking member, disposed on the chair backrest, where an outer end of the transverse locking member extends laterally from a lower end of the chair backrest, and the transverse locking member telescopically moves relative to the chair backrest in a transverse direction; a driving member, driving the outer end of the transverse locking member to extend into the locking hole; a front side resisting part, disposed on the fixing bracket and below the chair backrest, and located at a side of the chair backrest proximate to a human back; and a rear side resisting part, disposed on the lower end of the chair backrest. Therefore, the chair backrest can be folded and unfolded, and make the chair backrest stable under stress.

20 Claims, 11 Drawing Sheets

CHAIR BACKREST FOLDING LOCKING MECHANISM AND FOLDING CHAIR

CROSS-REFERENCE TO RELATED APPLICATION

This application claims priority to Chinese Patent Application No. 202323414231.0, filed on Dec. 14, 2023, which is herein incorporated by reference in its entirety.

TECHNICAL FIELD

The disclosure relates to the technical field of chair backrests, and more particularly to a chair backrest folding locking mechanism and a folding chair.

BACKGROUND

A chair, a common type of seating furniture on the market, includes a chair folding mechanism to avoid cumbersome disassembly and assembly during transportation, thereby achieving folding of a chair backrest above a seat cushion, that is, the chair backrest is in a horizontal state after being folded. Folding enables the chair to be accommodated in a more compact space, for example, a transportation space, a space under a desk and the like.

In the related art, two vertical sides of a plastic chair backrest are hinged to a seat cushion bracket using a hinge axis method. At this time, a top and a bottom of the chair backrest are in a free state. When a human back is against the chair backrest, the hinge axis serves as a force point and the chair backrest is subjected to a backward force from the human back, a hinge joint is prone to cracking, and the chair backrest is also subject to varying degrees of deformation.

SUMMARY

Aiming at the above problems of the related art, a purpose of the disclosure is to provide a chair backrest folding locking mechanism and a folding chair to solve the above technical problems.

The purpose of the disclosure can be achieved through the following technical schemes.

The chair backrest folding locking mechanism includes a fixing bracket, a chair backrest, a transverse locking member, a driving member, a front side resisting part and a rear side resisting part. Two sides of a lower end of the chair backrest are hinged on the fixing bracket, and the fixing bracket defines a locking hole disposed transversely. The transverse locking member is disposed on the chair bracket, an outer end of the transverse locking member extends laterally from the lower end of the chair backrest, and the transverse locking member is configured to telescopically move relative to the chair backrest in a transverse direction. The chair backrest folding locking mechanism further includes the driving member, and the driving member is configured to drive the outer end of the transverse locking member to extend into the locking hole. The front side resisting part is disposed on the fixing bracket, and the front side resisting part is disposed below the chair backrest and located at a side of the chair backrest proximate to a back of a human body. The rear side resisting part is disposed on the lower end of the chair backrest.

When the chair backrest is in a vertical state, the front side resisting part disposed on the fixing bracket and the rear side resisting part disposed on the chair backrest are arranged in a front and back manner, and a front side of the rear side resisting part is abutted against a rear side of the front side resisting part.

When the transverse locking member is separated from the locking hole, the chair backrest is configured to rotate with an angle less than 3600 relative to the fixing bracket under an external force.

In an embodiment, the chair backrest rotates with an angle less than 90° relative to the fixing bracket under the external force.

Specifically, the fixing bracket is U-shaped, and the lower end of the chair backrest extends into a U-shaped space of the fixing bracket.

Specifically, a number of the front side resisting part is two, and the two front side resisting parts are disposed on inner facades of two opposite vertical sections of the fixing bracket, respectively.

Specifically, lower ends of the two front side resisting parts extend downwards into corners between the two opposite vertical sections and a horizontal section of the fixing bracket.

Specifically, the driving member is a spring, a control button is disposed on an outer opening of the locking hole, the control button is configured to be in contact with the transverse locking member under driving of a lateral inward force, and the control button is configured to force the outer end of the transverse locking member to be separated from the locking hole.

Specifically, the transverse locking member is rod-shaped, the chair backrest defines a penetrating hole for the transverse locking member to be penetrated, the driving member is disposed in the penetrating hole, an end of the driving member is abutted against a blocking part of the penetrating hole, and the other end of the driving member is abutted against an inner end of the transverse locking member.

Specifically, a strip-shaped block is disposed on an outer opening of the penetrating hole, the strip-shaped block defines a guide hole with an axis line coincident with an axial line of the transverse locking member, the outer end of the transverse locking member is inserted into the guide hole, and the guide hole and the transverse locking member are in clearance fit.

Specifically, an anti-stripping cap is disposed on the inner end of the transverse locking member, the anti-stripping cap and the penetrating hole are in clearance fit, and the other end of the driving member is abutted against the anti-stripping cap.

Specifically, a side of the fixing bracket facing away from the human body defines a trajectory through groove disposed obliquely upwards, a lower end of the trajectory through groove is in communication with an inner opening of the locking hole, and an upper end of the trajectory through groove is configured to be in communication with outside; when unlocking the transverse locking member, the transverse locking member is separated from the locking hole, the chair backrest rotates around a hinge axis line to make the outer end of the transverse locking member enter the trajectory through groove and be separated from the trajectory through groove; and when locking the transverse locking member, the outer end of the transverse locking member is axially pressed to make the outer end of the transverse locking member return to the trajectory through groove, when the front side of the rear side resisting part is abutted against the rear side of the front side resisting part, the transverse locking member is driven to reinsert into the locking hole by the driving member, and the chair backrest is in the vertical state at this moment.

Specifically, a bottom of the trajectory through groove is an arc convex surface.

Specifically, a width of the trajectory through groove is gradually decreased from the upper end of the trajectory through groove to the lower end of the trajectory through groove.

Specifically, an anti-stripping part is disposed on the outer opening of the locking hole, an outer end of the control button extends out from the outer opening of the locking hole, a shoulder guard is disposed on a middle of the control button, and the shoulder guard is disposed in the locking hole, a telescopic spring is sleeved on the control button, an end of the telescopic spring is abutted against the shoulder guard, and the other end of the telescopic spring is configured to act on an inner opening blocking member of the locking hole.

Specifically, elasticity of the driving member is greater than elasticity of the telescopic spring.

Specifically, the strip-shaped block is fixed on the outer opening of the penetrating hole through two fasteners.

Specifically, the rear side resisting part and the chair backrest are integrally formed into one whole by injection molding; and the front side resisting part and the fixing bracket are integrally formed into one whole by injection molding.

Specifically, each of the two opposite vertical sections of the fixing bracket is hinged with the chair backrest through a hinge axis.

The disclosure provides a folding chair, including a seat. The seat is connected with the chair backrest folding locking mechanism as described above, and the chair backrest of the chair backrest folding locking mechanism is located above the seat when the chair backrest is folded and placed horizontally.

Specifically, left and right sides of the chair backrest are provided with angle adjustable armrests respectively, and a lumbar support is disposed on a middle of the chair backrest.

Specifically, an end of each of the angle adjustable armrests is hinged with the chair backrest, at least one arc-shaped convex block is disposed on the end of each of the angle adjustable armrests, a corresponding side of the chair backrest defines at least one arc-shaped trajectory groove into which the at least one arc-shaped convex block of each of the angle adjustable armrests extend one by one, when each of the angle adjustable armrests rotates relative to the chair backrest, each arc-shaped convex block moves relative to the arc-shaped trajectory groove, the end of each of the angle adjustable armrests defines multiple locking concavities arranged in a circumferential manner, the corresponding side of the chair backrest further defines a transverse blind hole, and a locking ball is disposed on an opening of the transverse blind hole, a spring member is disposed in the transverse blind hole, an end of the spring member is abutted against a bottom of the transverse blind hole, the other end of the spring member is abutted against the locking ball, and the spring member is configured to force at least a part of the locking ball to be stuck in any one of the multiple locking concavities.

Specifically, the middle of the chair backrest defines multiple locking grooves sequentially connected from top to bottom, a cantilever slider is disposed on a rear side of the lumbar support, and the cantilever slider is slidably connected with the chair backrest in a vertical direction, a locking part is disposed on the cantilever slider, and the locking part is configured to be matched with any one of the multiple locking grooves; and when the lumbar support rises and falls under a vertical force, the locking part is separated from a current one of the multiple locking grooves to a next one of the multiple locking grooves.

Compared with the related art, the chair backrest folding locking mechanism of the disclosure has the following beneficial effects.

In the disclosure, problems of deformation caused by force during a leaning process of existing chair backrests and a cracking phenomenon at a hinge axis of the chair backrest are solved. The fixing bracket defines the locking hole, the chair backrest is provided with the transverse locking member thereon, the outer end of the transverse locking member extends laterally from the lower end of the chair backrest, and the transverse locking member is configured to telescopically move relative to the chair backrest in the transverse direction, the driving member is configured to drive the outer end of the transverse locking member to extend into the locking hole for locking fixation. Meanwhile, the fixing bracket is provided with the front side resisting part located below the chair backrest, and the chair backrest is provided with the rear side resisting part located at the lower end of the chair backrest. When the chair backrest is in a vertical state, the transverse locking member is locked and fixed with the locking hole, the front side resisting part and the rear side resisting part are arranged in the front and back manner, and the front side of the rear side resisting part is abutted against the rear side of the front side resisting part.

LIST OF REFERENCE NUMBER

Figure 1:
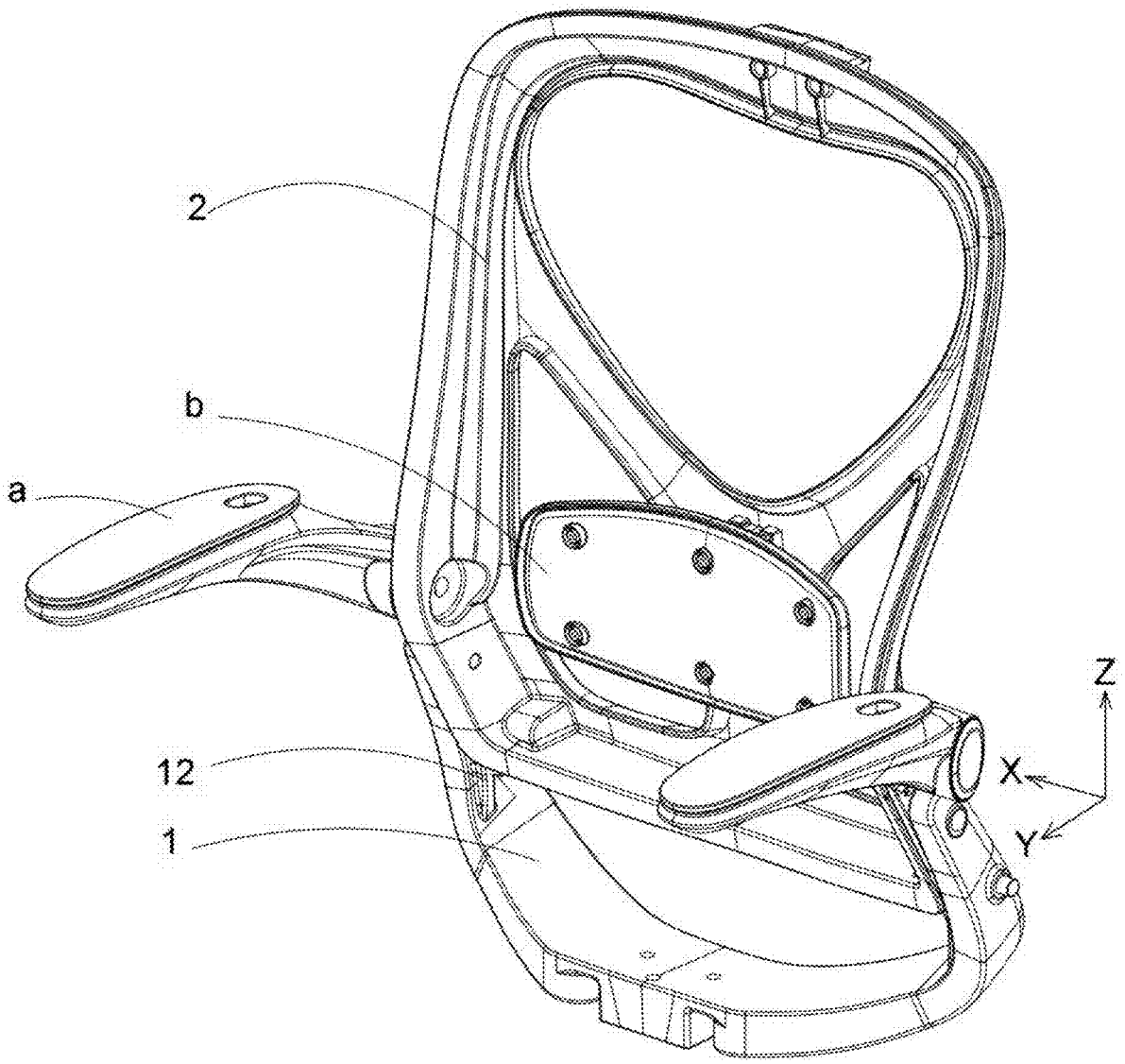
FIG. 1 illustrates a schematic structural diagram of a chair backrest folding locking mechanism according to an embodiment of the disclosure.

1—fixing bracket; 11—locking hole; 111—anti-stripping part; 112—inner opening blocking member; 12—front side resisting part; 13—trajectory through groove; 2—chair backrest; 21—rear side resisting part; 22—penetrating hole; 221—blocking part; 23—arc-shaped trajectory groove; 24—transverse blind hole; 25—locking groove; 3—transverse locking member; 31—anti-stripping cap; 4—driving member; 5—control button; 51—shoulder guard; 6—strip-shaped block; 61—guide hole; 7—telescopic spring; 8—fastener; 9—hinge axis; 10—seat; a-angle adjustable armrest; a1—arc-shaped convex block; a2—locking concavity; a3—locking ball; a4—spring member; b—lumbar support; b1—cantilever slider; b2—locking part; c—U-shaped block; c1—slideway.

DETAILED DESCRIPTION OF EMBODIMENTS

The followings are specific embodiments of the disclosure, and technical solutions of the disclosure will be further described in conjunction with drawings, but the disclosure is not limited by these embodiments.

Embodiment 1

As shown in FIGS. 1-9, a chair backrest folding locking mechanism includes a fixing bracket 1, a chair backrest 2, a transverse locking member 3, a driving member 4, a front side resisting member 12 and a rear side resisting member 21. Two sides of a lower end of the chair backrest 2 are hinged on the fixing bracket 1, the fixing bracket 1 and the chair backrest 2 are made from a plastic material, and the chair backrest 2 is configured to perform angular adjustment movement with respect to the fixing bracket 1 at hinge points. For example, a coordinate system XYZ is taken as an example, and the chair backrest 2 rotates around an X-axis.

The fixing bracket 1 defines a locking hole 11 disposed transversely, that is, the locking hole 11 is arranged along the X-axis. The transverse locking member 3 is disposed on the chair backrest 2, an outer end of the transverse locking member 3 extends laterally from the lower end of the chair backrest 2, and the transverse locking member 3 is configured to telescopically move relative to the chair backrest 2 in a transverse direction. The chair backrest folding locking mechanism further includes the driving member 4, and the driving member 4 drives the outer end of the transverse locking member 3 to extend into the locking hole 11. The driving member 4 is an elastic driving member, and an elastic force of the driving member 4 drives the transverse locking member 3 to insert into the locking hole 11. A state of the chair backrest 2 at this time refers to FIG. 1.

The state of the chair backrest 2 in FIG. 1 is taken as an example, the chair backrest 2 counterclockwise rotates by a certain angle around the X-axis, to make the chair backrest 2 can be folded.

The front side resisting part 12 is disposed on the fixing bracket 1, and the front side resisting part 12 is disposed below the chair backrest 2 and located at a side of the chair backrest 2 proximate to a back of a human body. The rear side resisting part 21 is disposed on the lower end of the chair backrest 2.

When the chair backrest 2 is in the state shown in FIG. 1, the front side resisting part 12 disposed on the fixing bracket 1 and the rear side resisting part 21 disposed on the chair backrest 2 are arranged in a front and back manner, and a front side of the rear side resisting part 21 is abutted against a rear side of the front side resisting part 12. When the transverse locking member 3 is inserted into the locking hole 11, the chair backrest folding locking mechanism is in a locked state, otherwise, the chair backrest folding locking mechanism is in an unlocked state.

Through a synergistic effect of two front side resisting parts 12 and two rear side resisting parts 21, combining the locked state between the locking hole 11 and the transverse locking member 3, and further combining the two-sided hinge method, limit reinforcement in multiple dimensions of the chair backrest folding locking mechanism can be achieved when the chair backrest 2 is subjected to pressure from the human body's back, stress is dispersed, thereby preventing the chair backrest 2 from experiencing significant deformation or cracking due to only vertical relative forces on opposite sides.

When the transverse locking member 3 is separated from the locking hole 11, the chair backrest 2 rotates with an angle less than 3600 relative to the fixing bracket 1 under an external force. The angle can be an angle value ranges from 90° to 120°.

For example, when a person leaves the chair and stands on the side of the chair, the transverse locking member 3 is separated from the locking hole 11 at this time, and the chair backrest 2 is counterclockwise rotated 90° under an action of human hands, to thereby fold the chair backrest 2. Folding makes it easy for the chair to be stored below a desktop, and the folding can also effectively reduce a space occupied by the chair during transportation.

Specifically, in the embodiment, the fixing bracket 1 is U-shaped, the lower end of the chair backrest 2 extends into a U-shaped space of the fixing bracket 1, to achieve folding and adjustment of the chair backrest 2 in the U-shaped space.

Figure 3:
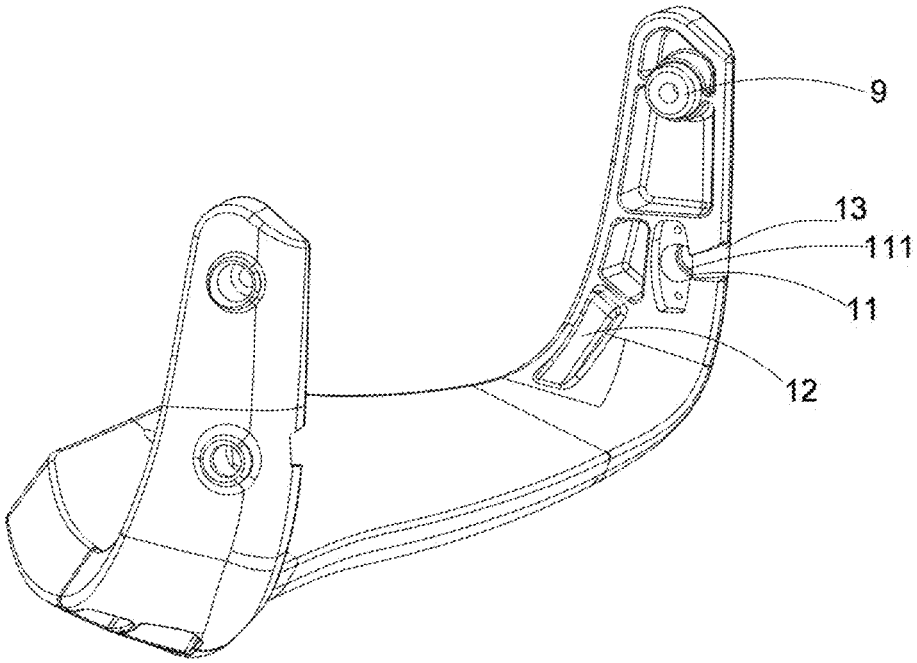
FIG. 3 illustrates a schematic structural diagram of a fixing bracket of the chair backrest folding locking mechanism in FIG. 1 according to an embodiment of the disclosure.

As shown in FIG. 1 and FIG. 3, in order to ensure resistance stability between the front side resisting part 12 and the rear side resisting part 21 when the chair backrest 2 is in the vertical state, a number of the front side resisting part 12 is two, and the two front side resisting parts 12 are disposed on inner facades of two opposite vertical sections of the fixing bracket 1, respectively. Specifically, lower ends of the two front side resisting parts 12 extend downwards into corners between the vertical sections and a horizontal section of the fixing bracket 1.

Figure 10:
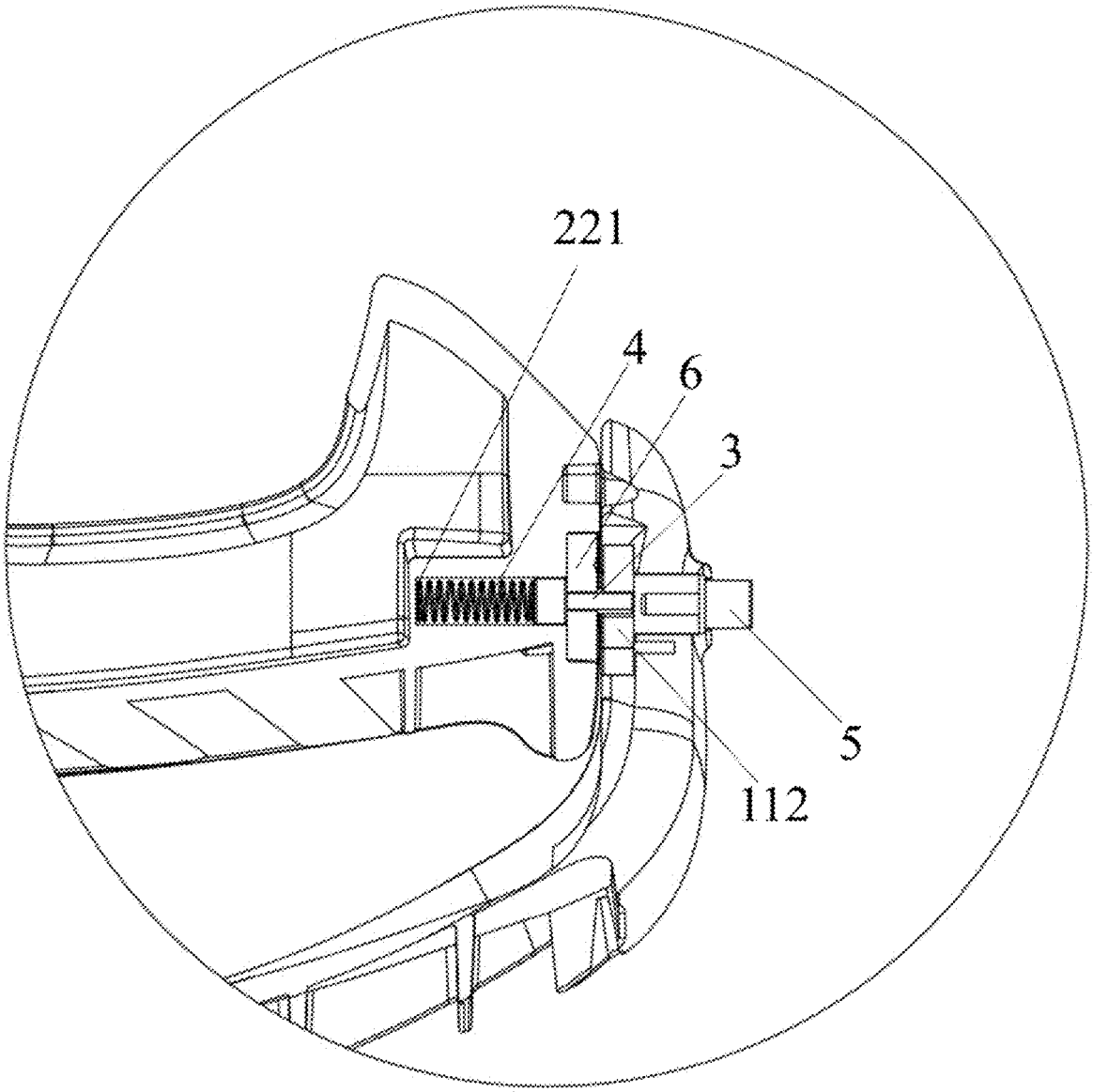
FIG. 10 illustrates a partially sectional diagram of the chair backrest folding locking mechanism in a locking state according to an embodiment of the disclosure.
Figure 11:
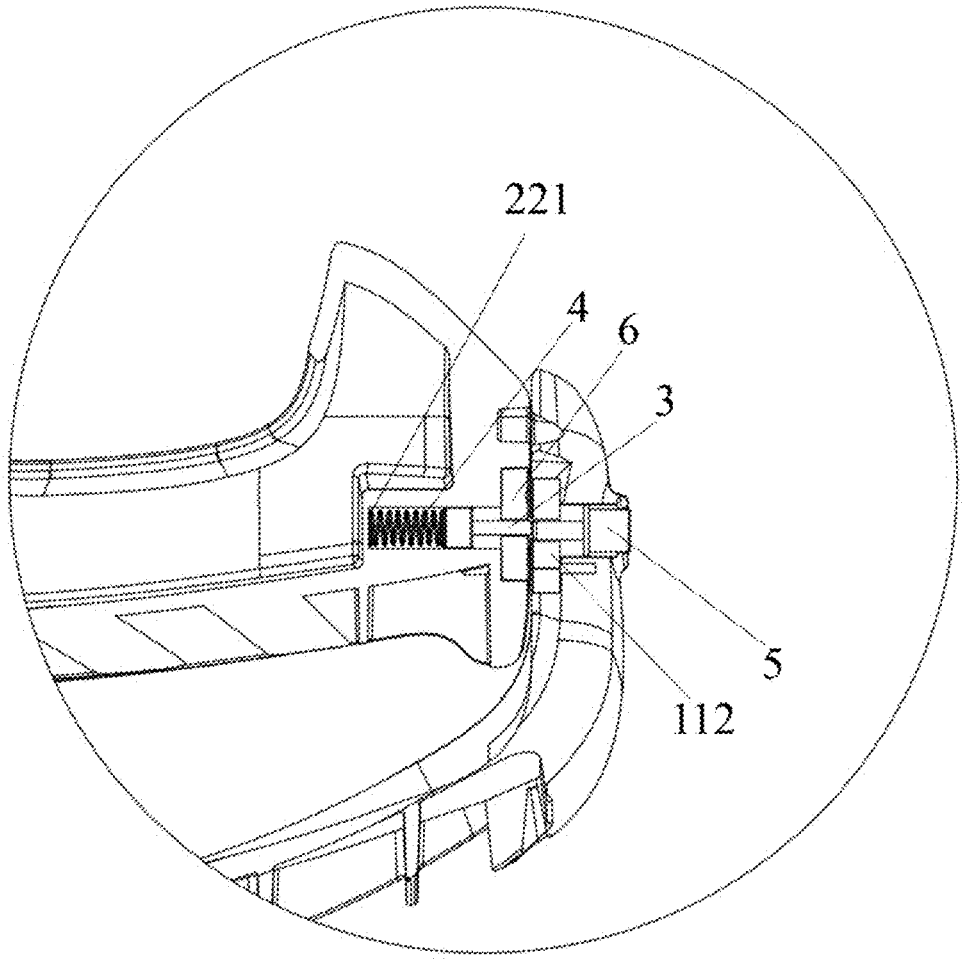
FIG. 11 illustrates a partially sectional diagram of the chair backrest folding locking mechanism in an unlocking state according to an embodiment of the disclosure.
Figure 12:
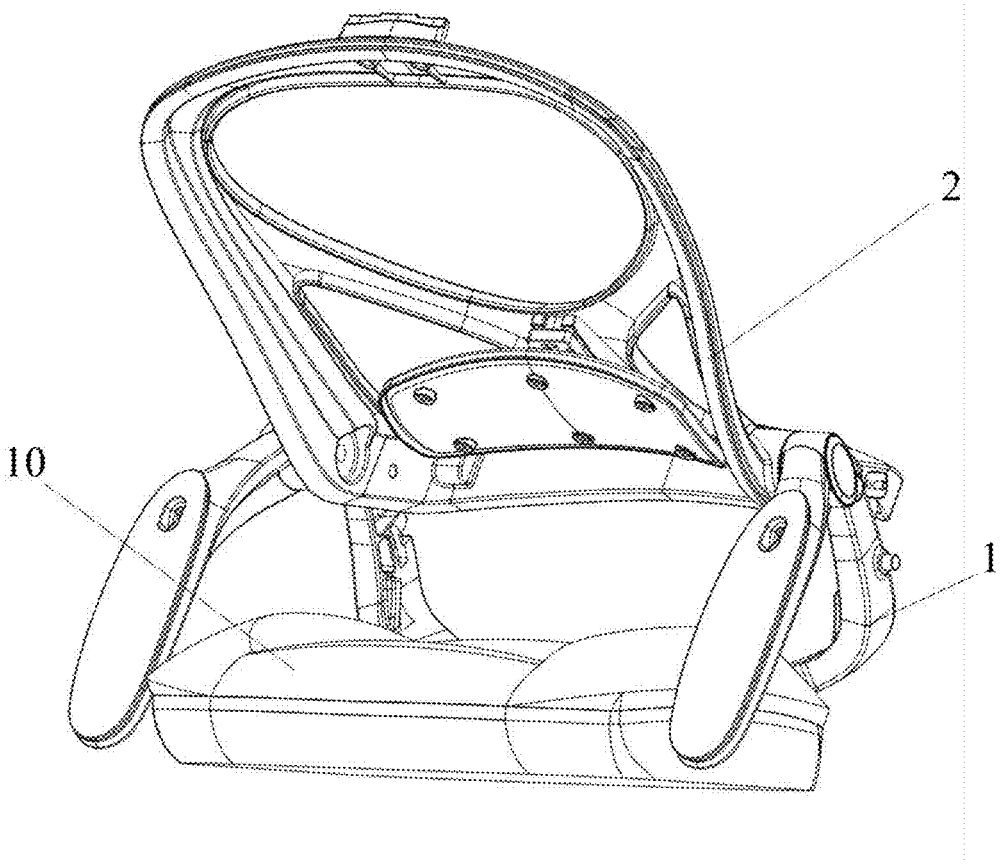
FIG. 12 illustrates a schematic structural diagram of a folding chair in a folded state according to an embodiment of the disclosure.

As shown in FIG. 1, FIG. 3, FIG. 4 and FIG. 6, in the embodiment, in order to extend the transverse locking member 3 into the locking hole 11 or separate the transverse locking member 3 from the locking hole 11, the driving member 4 is a spring, and the driving member 4 drives the outer end of the transverse locking member 3 to extend into the locking hole 11. A control button 5 is disposed on an outer opening of the locking hole 11, the control button 5 is in contact with the transverse locking member 3 under driving of a lateral inward force, and the control button 5 forces the outer end of the transverse locking member 3 be separated from the locking hole 11. When the chair backrest 2 is in the vertical state, the driving member 4 drives the outer end of the transverse locking member 3 to extend into the locking hole 11, to vertically lock the chair backrest 2 onto the fixing bracket 1. As shown in FIG. 10 and FIG. 11, the control button 5 forces the outer end of the transverse locking member 3 to be separated from the locking hole 11 under the lateral inward force, to thereby make the chair backrest 2 to rotate by a certain angle relative to the fixing bracket 1.

Figure 2:
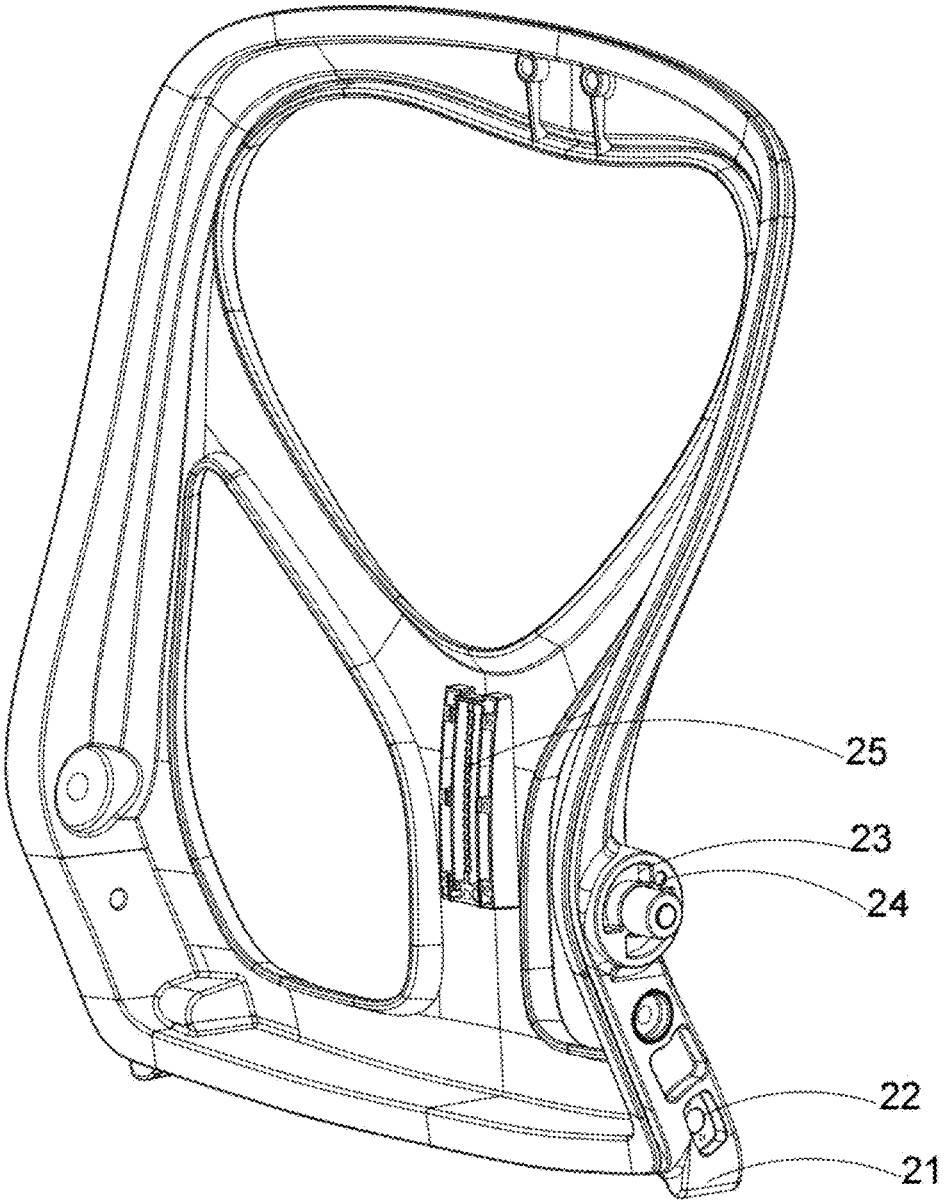
FIG. 2 illustrates a schematic structural diagram of a chair backrest of the chair backrest folding locking mechanism in FIG. 1 according to an embodiment of the disclosure.
Figure 4:
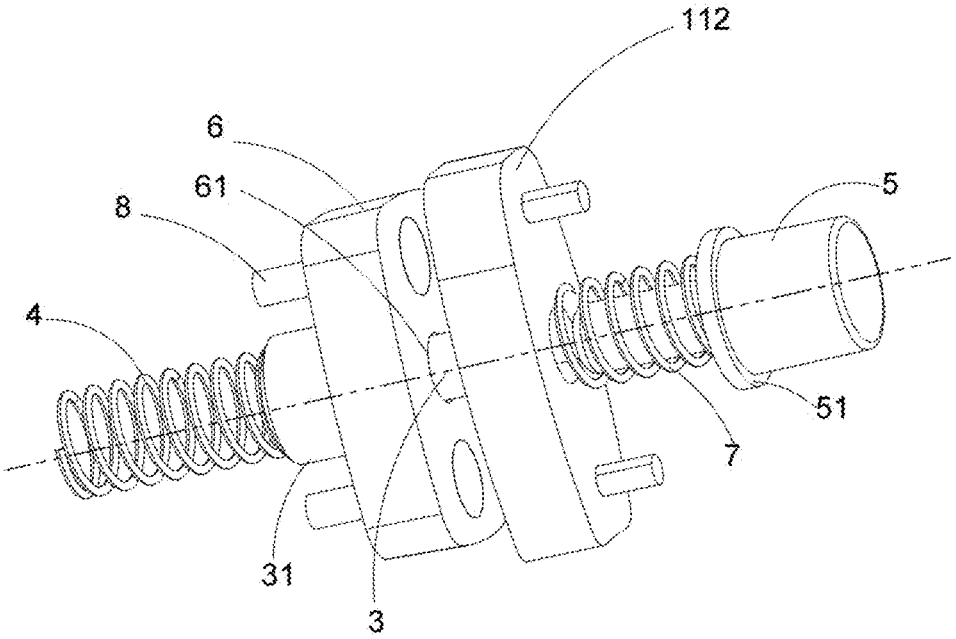
FIG. 4 illustrates a partially schematic structural diagram of FIG. 1 according to an embodiment of the disclosure.
Figure 5:
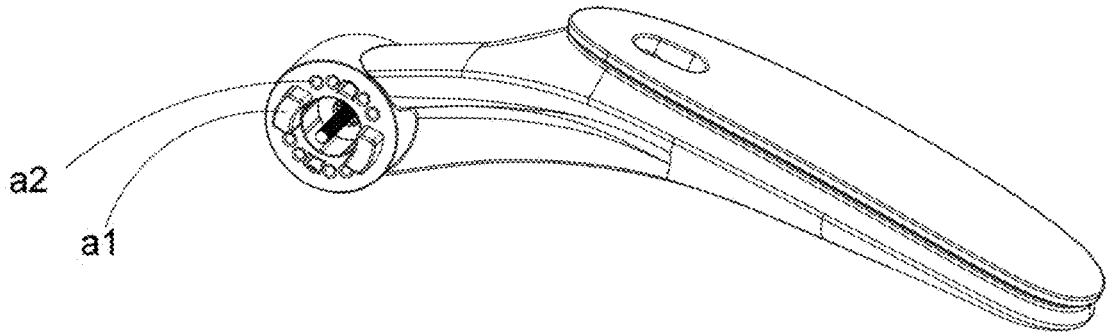
FIG. 5 illustrates a schematic structural diagram of an angle adjustable armrest in FIG. 1 according to an embodiment of the disclosure.
Figure 6:
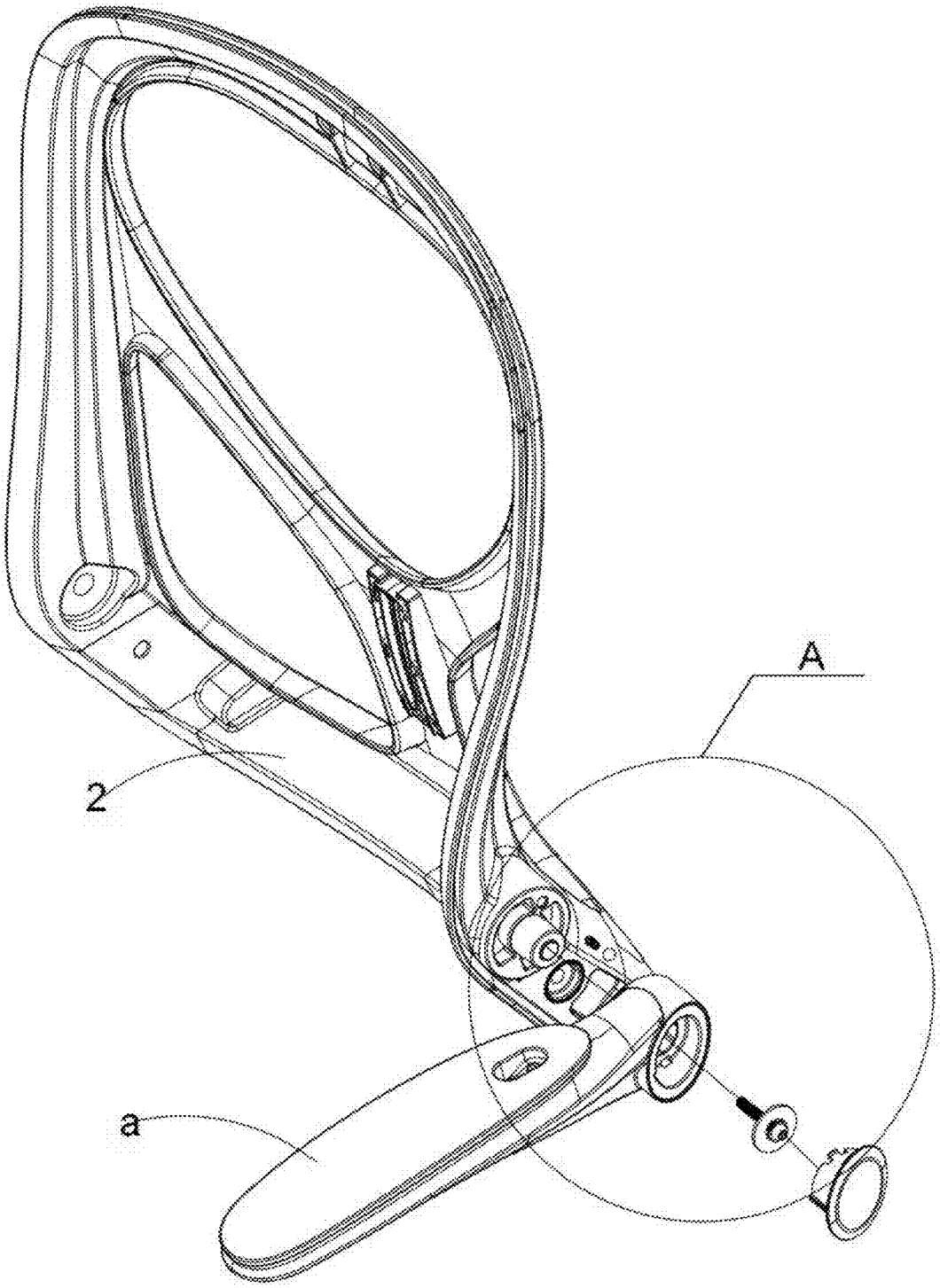
FIG. 6 illustrates an exploded diagram of the chair backrest and the angle adjustable armrest in FIG. 1 according to an embodiment of the disclosure.
Figure 7:
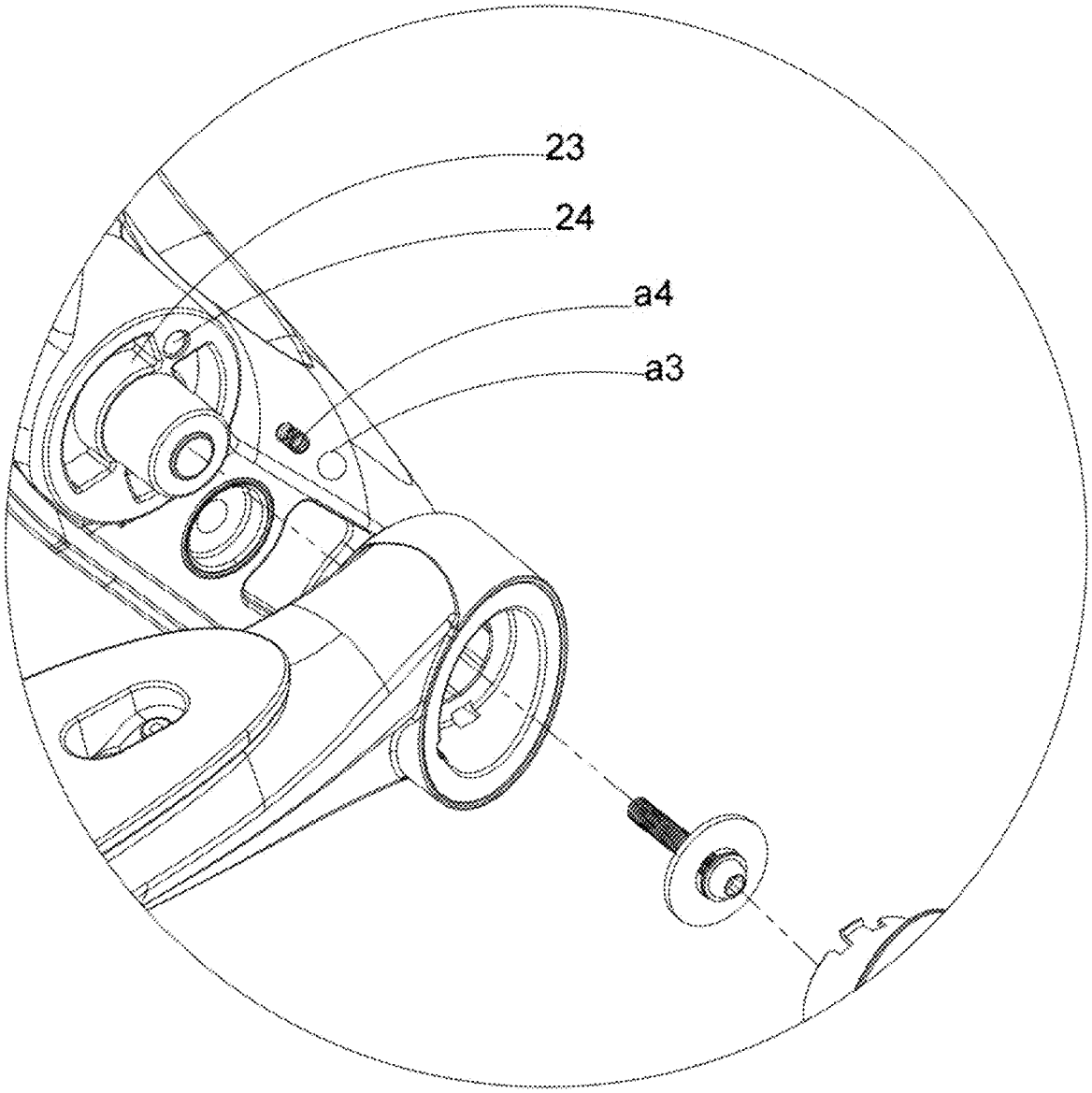
FIG. 7 illustrates a partially enlarged diagram of a position A in FIG. 6 according to an embodiment of the disclosure.

As shown in FIG. 1, FIG. 2 and FIG. 4, in order to dispose the driving member 4 in the chair backrest 2, the transverse locking member 3 is rod-shaped, the chair backrest 2 defines a penetrating hole 22 for the transverse locking member 3 to be penetrated, the driving member 4 is disposed in the penetrating hole 22, an end of the driving member 4 is abutted against a blocking part 221 of the penetrating hole 22, and the other end of the driving member 4 is abutted against an inner end of the transverse locking member 3.

As shown in FIG. 4, in order to achieve connection between the transverse locking member 3 and a strip-shaped block 6, the strip-shaped block 6 is disposed on an outer opening of the penetrating hole 22, and the strip-shaped block 6 defines a guide hole 61 with an axis line that coincides with an axis line of the transverse locking member 3. The outer end of the transverse locking member 3 is inserted into the guide hole 61, and the guide hole 61 and the transverse locking member 3 are in clearance fit.

Specifically, in the embodiment, an anti-stripping cap 31 is disposed on the inner end of the transverse locking member 3, the anti-stripping cap 31 and the penetrating hole 22 are in clearance fit, and the other end of the driving member 4 is abutted against the anti-stripping cap 31.

As shown in FIG. 1, FIG. 2, FIG. 3, FIG. 4, FIG. 6 and FIG. 8, in order to unlock or lock the transverse locking member 3 along a trajectory through groove 13, the trajectory through groove 13 is defined on a side of the fixing bracket 1 facing away from the human body, and the trajectory through groove 13 is disposed obliquely upwards. A lower end of the trajectory through groove 13 is in communication with an inner opening of the locking hole 11, and an upper end of the trajectory through groove 13 is configured to be in communication with outside.

When unlocking the transverse locking member 3, the transverse locking member 3 is separated from the locking hole 11, the chair backrest 2 rotates around a hinge axis line to make the outer end of the transverse locking member 3 enter the trajectory through groove 13 and be separated from the trajectory through groove 13.

When locking the transverse locking member 3, the outer end of the transverse locking member 3 is axially pressed to make the outer end of the transverse locking member 3 return to the trajectory through groove 13, when the front side of the rear side resisting part 21 is abutted against the rear side of the front side resisting part 12, the transverse locking member 3 is driven to reinsert into the locking hole 11 by the driving member 4, and the chair backrest 2 is in the vertical state at this time.

As shown in FIG. 1, FIG. 3 and FIG. 4, in order to separate the outer end of the transverse locking member 3 from the locking hole 11, a bottom of the trajectory through groove 13 is an arc convex surface, the outer end of the transverse locking member 3 is in contact with the arc convex surface, and the transverse locking member 3 moves along a length direction of the trajectory through groove 13 under guidance of the trajectory through groove 13. Specifically, in the disclosure, a width of the trajectory through groove 13 is gradually decreased from the upper end of the trajectory through groove 13 to the lower end of the trajectory through groove 13, to precisely move the transverse locking member 3 into the locking hole 11.

In the embodiment, in order to avoid detachment of the control button 5 from the locking hole 11, an anti-stripping part 111 is disposed on the outer opening of the locking hole 11, and an outer end of the control button 5 extends from the outer opening of the locking hole 11. A shoulder guard 51 is disposed on a middle of the control button 5, and the shoulder guard 51 is disposed in the locking hole 11. A telescopic spring 7 is sleeved on the control button 5, an end of the telescopic spring 7 is abutted against the shoulder guard 51, the other end of the telescopic spring 7 is configured to act on an inner opening blocking member 112 of the locking hole 11. Specifically, a center area of the inner opening blocking member 112 defines a through hole penetrating the locking hole 11. Certainly, the locking hole 11 can be directly defined on the center area of the inner opening blocking member 112, which can also lock and unlock the transverse locking member 3.

As shown in FIG. 3 and FIG. 4, in the embodiment, in order to extend the outer end of the transverse locking member 3 into the locking hole 11, elasticity of the driving member 4 is greater than elasticity of the telescopic spring 7, to thereby provide a stable locked state.

As shown in FIG. 1, FIG. 2, FIG. 4 and FIG. 6, in order to achieve positioning between the strip-shaped block 6 and the chair backrest 2, the strip-shaped block 6 is fixed on the outer opening of the penetrating hole 22 through two fasteners 8.

In the embodiment, in order to realize stability of connection between the rear side resisting parts 21 and the chair backrest 2, the rear side resisting parts 21 and the chair backrest 2 are integrally formed into one whole by injection molding, and the front side resisting parts 12 and the fixing bracket 1 are integrally formed into one whole by injection molding. The integrated injection molding method has more stable quality and higher overall hardness.

As shown in FIG. 1 and FIG. 3, in the embodiment, in order to realize good connection between the fixing bracket 1 and the chair backrest 2, each vertical section of the fixing bracket 1 is hinged with the chair backrest 2 through a hinge axis 9.

In the embodiment of the disclosure, the problem of deformation caused by force during a leaning process of the existing chair backrest is solved. The fixing bracket 1 defines the locking hole 11, the chair backrest 2 is provided with the transverse locking member 3 thereon, the outer end of the transverse locking member 3 extends out from the chair backrest 2, and the transverse locking member 3 is configured to telescopically move relative to the chair backrest 2 in the transverse direction. The driving member 4 drives the outer end of the transverse locking member 3 to extend into the locking hole 11 for locking fixation. Meanwhile, the fixing bracket 1 is provided with the front side resisting part 12 located below the chair backrest 2, and the chair backrest 2 is provided with the rear side resisting part 21 located at the lower end of the chair backrest 2. When the chair backrest is in the vertical state, the transverse locking member 3 is locked and fixed with the locking hole 11, the front side resisting part 12 and the rear side resisting part 21 are arranged in the front and back manner, and the front side of the rear side resisting part 21 is abutted against the rear side of the front side resisting part 12. When the transverse locking member 3 is separated from the locking hole 11, the chair backrest 2 rotates with an angle less than 360° relative to the fixing bracket 1 under the external force.

Embodiment 2

As shown in FIG. 1 to FIG. 9, a folding chair includes a seat 10, the seat 10 is connected with the chair backrest folding locking mechanism of the above embodiment 1, and the chair backrest 2 of the chair backrest folding locking mechanism is located above the seat 10 when the chair backrest 2 is folded placed horizontally.

As shown in FIG. 1, FIG. 7, FIG. 8 and FIG. 9, angle adjustable armrests a are disposed on left and right sides of the chair backrest 2 respectively, and a lumbar support b is disposed on a middle of the chair backrest 2.

Specifically, in the embodiment, an end of each angle adjustable armrest a is hinged with the chair backrest 2. At least one arc-shaped convex block a1 is disposed on the end of the angle adjustable armrest a, and a corresponding side of the chair backrest 2 defines at least one arc-shaped trajectory groove 23 into which the at least one arc-shaped convex block a1 of each of the angle adjustable armrests a extend one by one. When the angle adjustable armrest a rotates relative to the chair backrest 2, each arc-shaped convex block a1 moves relative to the arc-shaped trajectory groove 23. The end of the angle adjustable armrest a further defines multiple locking concavities a2 arranged in a circumferential manner, and the corresponding side of the chair backrest 2 defines a transverse blind hole 24. A locking ball a3 is disposed on an opening of the transverse blind hole 24, and a spring member a4 is disposed in the transverse blind hole 24. An end of the spring member a4 is abutted against a bottom of the transverse blind hole 24, the other end of the spring member a4 is abutted against the locking ball a3, and the spring member a4 forces at least a part of the locking ball a3 to be stuck in any one of the multiple locking concavities a2.

The locking ball a3 is stuck in the locking concavity a2 to achieve adjustment with different angles of the angle adjustable armrest a, to thereby facilitate storage.

Figure 8:
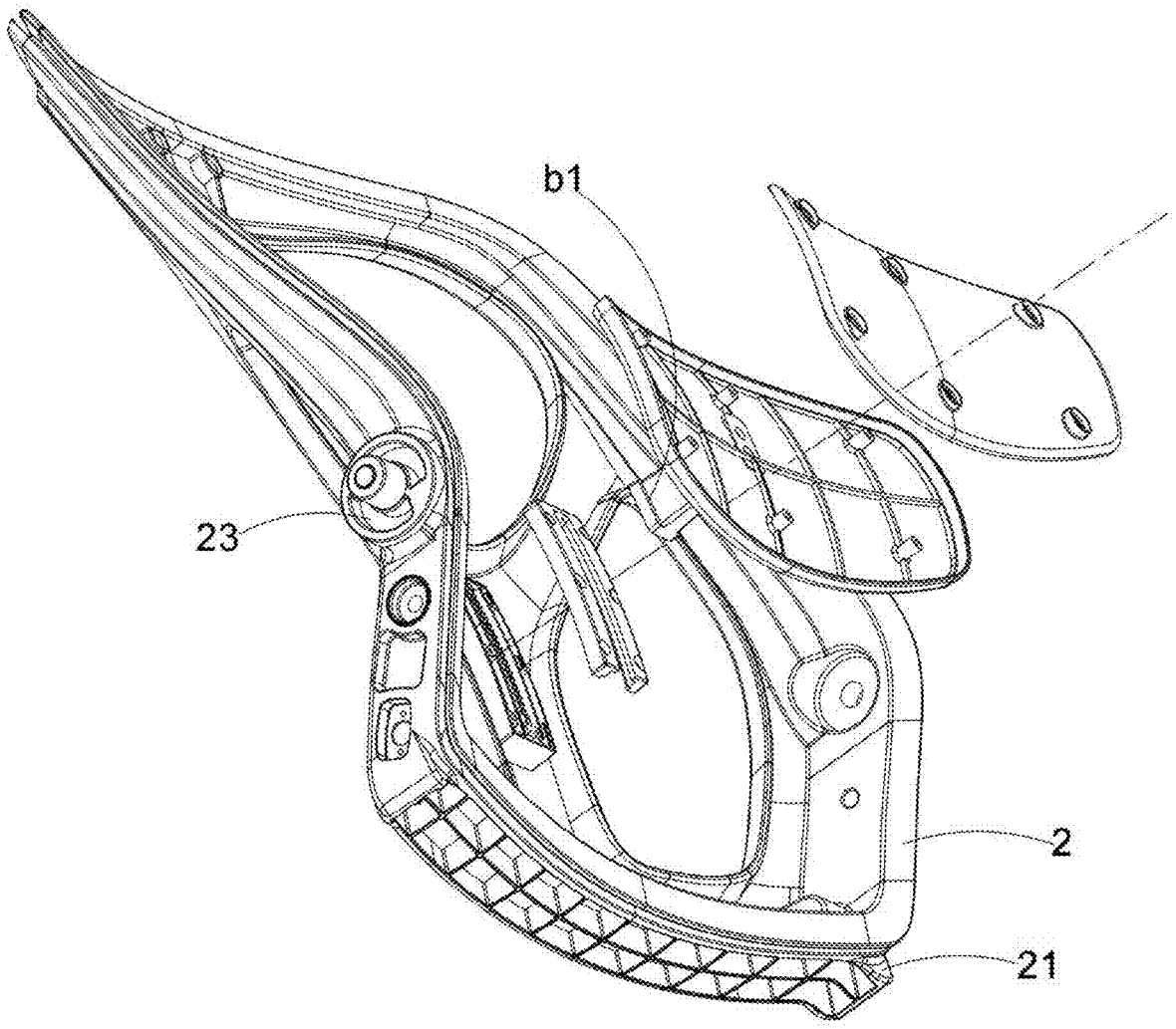
FIG. 8 illustrates an exploded diagram of the chair backrest and a lumbar support in FIG. 1 according to an embodiment of the disclosure.
Figure 9:
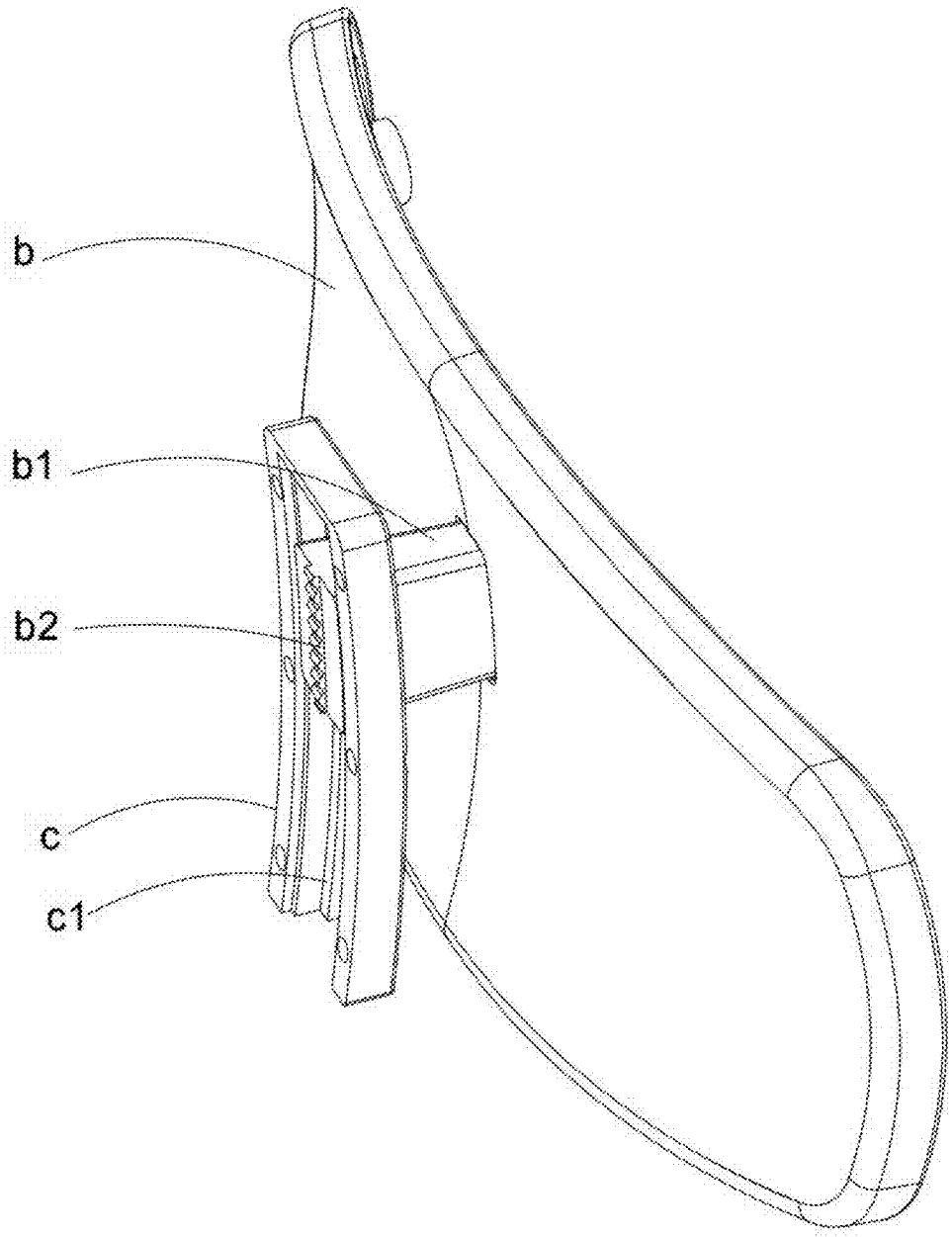
FIG. 9 illustrates a schematic structural diagram of the lumbar support in FIG. 1 according to an embodiment of the disclosure.

As shown in FIG. 8 and FIG. 9, in order to achieve a locking fit between the lumbar support b and locking grooves 25, the middle of the chair backrest 2 defines multiple locking grooves 25 sequentially connected from top to bottom, a cantilever slider b1 is disposed on a rear side of the lumbar support b, and the cantilever slider b1 is slidably connected with the chair backrest 2 in a vertical direction, a locking part b2 is disposed on the cantilever slider b1, and the locking part b2 is matched with any one of the locking grooves 25. The locking part b2 is an elastic locking part, for example, a deformable elastic structure resembling "Q", which is beneficial for elastic deformation of the locking part b2 to stick the locking part b2 on any different locking groove 25.

The locking part b2 is separated from the current locking groove 25 and enters into the next locking groove 25 when the lumbar support b is raised or fallen under the vertical force. Specifically, a U-shaped block c is disposed above the locking grooves 25, an inner side of the U-shaped block c is provided with a slideway c1, the cantilever slider b1 extends into the U-shaped block c and is connected to the slideway c1, to thereby achieve vertical sliding of the cantilever slider b1 on the chair backrest 2.

In the description of the disclosure, it should be noted that unless otherwise specified and limited, terms "installation", "connection", and "connected" should be broadly understood. For example, they can be fixed connections, detachable connections, or integrated connections. It can be a mechanical connection or an electrical connection. It can be directly connected, or indirectly connected through an intermediate medium, or it can be an internal connection between two components. For those skilled in the art, specific meanings of the above terms in the disclosure can be understood in specific situations.

What is claimed is:

1. A chair backrest folding locking mechanism, comprising:

a fixing bracket (1); wherein the fixing bracket (1) defines a locking hole (11) disposed transversely;

a chair backrest (2); wherein two sides of a lower end of the chair backrest (2) are hinged on the fixing bracket (1);

a transverse locking member (3), disposed on the chair backrest (2); wherein an outer end of the transverse locking member (3) extends laterally from the lower end of the chair backrest (2), and the transverse locking member (3) is configured to telescopically move relative to the chair backrest (2) in a transverse direction;

a driving member (4), configured to drive the outer end of the transverse locking member (3) to extend into the locking hole (11);

a front side resisting part (12), disposed on the fixing bracket (1); wherein the front side resisting part (12) is disposed below the chair backrest (2) and located at a side of the chair backrest (2) proximate to a back of a human body; and a rear side resisting part (21), disposed on the lower end of the chair backrest (2);

when the chair backrest (2) is in a vertical state, the front side resisting part (12) disposed on the fixing bracket (1) and the rear side resisting part (21) disposed on the chair backrest (2) being arranged in a front and back manner, and a front side of the rear side resisting part (21) being abutted against a rear side of the front side resisting part (12); and when the transverse locking member (3) is separated from the locking hole (11), the chair backrest (2) being configured to rotate with an angle less than 360° relative to the fixing bracket (1) under an external force.

2. The chair backrest folding locking mechanism as claimed in claim 1, wherein the fixing bracket (1) is U-shaped, and the lower end of the chair backrest (2) extends into a U-shaped space of the fixing bracket (1).

3. The chair backrest folding locking mechanism as claimed in claim 2, wherein a number of the front side resisting part (12) is two, and the two front side resisting parts (12) are disposed on inner facades of two opposite vertical sections of the fixing bracket (1), respectively.

4. The chair backrest folding locking mechanism as claimed in claim 3, wherein lower ends of the two front side resisting parts (12) extend downwards into corners between the two opposite vertical sections and a horizontal section of the fixing bracket (1).

5. The chair backrest folding locking mechanism as claimed in claim 3, wherein each of the two opposite vertical sections of the fixing bracket (1) is hinged with the chair backrest (2) through a hinge axis (9).

6. The chair backrest folding locking mechanism as claimed in claim 1, wherein the driving member (4) is a spring, a control button (5) is disposed on an outer opening of the locking hole (11), the control button (5) is configured to be in contact with the transverse locking member (3) under driving of a lateral inward force, and the control button (5) is configured to force the outer end of the transverse locking member (3) to be separated from the locking hole (11).

7. The chair backrest folding locking mechanism as claimed in claim 6, wherein the transverse locking member (3) is rod-shaped, the chair backrest (2) defines a penetrating hole (22) for the transverse locking member (3) to be penetrated, the driving member (4) is disposed in the penetrating hole (22), an end of the driving member (4) is abutted against a blocking part (221) of the penetrating hole (22), and the other end of the driving member (4) is abutted against an inner end of the transverse locking member (3).

8. The chair backrest folding locking mechanism as claimed in claim 7, wherein a strip-shaped block (6) is disposed on an outer opening of the penetrating hole (22), the strip-shaped block (6) defines a guide hole (61) with an axis line coincident with an axial line of the transverse locking member (3), the outer end of the transverse locking member (3) is inserted into the guide hole (61), and the guide hole (61) and the transverse locking member (3) are in clearance fit.

9. The chair backrest folding locking mechanism as claimed in claim 8, wherein an anti-stripping cap (31) is disposed on the inner end of the transverse locking member (3), the anti-stripping cap (31) and the penetrating hole (22) are in clearance fit, and the other end of the driving member (4) is abutted against the anti-stripping cap (31).

10. The chair backrest folding locking mechanism as claimed in claim 8, wherein the strip-shaped block (6) is fixed on the outer opening of the penetrating hole (22) through two fasteners (8).

11. The chair backrest folding locking mechanism as claimed in claim 7, wherein a side of the fixing bracket (1) facing away from the human body defines a trajectory through groove (13) disposed obliquely upwards, a lower end of the trajectory through groove (13) is in communication with an inner opening of the locking hole (11), and an upper end of the trajectory through groove (13) is configured to be in communication with outside;

when unlocking the transverse locking member (3), the transverse locking member (3) is separated from the locking hole (11), the chair backrest (2) rotates around a hinge axis line to make the outer end of the transverse locking member (3) enter the trajectory through groove (13) and be separated from the trajectory through groove (13); and when locking the transverse locking member (3), the outer end of the transverse locking member (3) is axially pressed to make the outer end of the transverse locking member (3) return to the trajectory through groove (13), when the front side of the rear side resisting part (21) is abutted against the rear side of the front side resisting part (12), the transverse locking member (3) is driven to reinsert into the locking hole (11) by the driving member (4), and the chair backrest (2) is in the vertical state at this moment.

12. The chair backrest folding locking mechanism as claimed in claim 11, wherein a bottom of the trajectory through groove (13) is an arc convex surface.

13. The chair backrest folding locking mechanism as claimed in claim 11, wherein a width of the trajectory through groove (13) is gradually decreased from the upper end of the trajectory through groove (13) to the lower end of the trajectory through groove (13).

14. The chair backrest folding locking mechanism as claimed in claim 7, wherein an anti-stripping part (111) is disposed on the outer opening of the locking hole (11), an outer end of the control button (5) extends out from the outer opening of the locking hole (11), a shoulder guard (51) is disposed on a middle of the control button (5), and the shoulder guard (51) is disposed in the locking hole (11), a telescopic spring (7) is sleeved on the control button (5), an end of the telescopic spring (7) is abutted against the shoulder guard (51), and the other end of the telescopic spring (7) is configured to act on an inner opening blocking member (112) of the locking hole (11).

15. The chair backrest folding locking mechanism as claimed in claim 14, wherein elasticity of the driving member (4) is greater than elasticity of the telescopic spring (7).

16. The chair backrest folding locking mechanism as claimed in claim 1, wherein the rear side resisting part (21) and the chair backrest (2) are integrally formed into one whole by injection molding; and the front side resisting part (12) and the fixing bracket (1) are integrally formed into one whole by injection molding.

17. A folding chair, comprising a seat (10), wherein the seat (10) is connected with the chair backrest folding locking mechanism as claimed in claim 1, and the chair backrest (2) of the chair backrest folding locking mechanism is located above the seat (10) when the chair backrest (2) is folded and placed horizontally.

18. The folding chair as claimed in claim 17, wherein left and right sides of the chair backrest (2) are provided with angle adjustable armrests (a) respectively, and a lumbar support (b) is disposed on a middle of the chair backrest (2).

19. The folding chair as claimed in claim 18, wherein an end of each of the angle adjustable armrests (a) is hinged with the chair backrest (2), at least one arc-shaped convex block (a1) is disposed on the end of each of the angle adjustable armrests (a), a corresponding side of the chair backrest (2) defines at least one arc-shaped trajectory groove (23) into which the at least one arc-shaped convex block (a1) of each of the angle adjustable armrests (a) extend one by one, when each of the angle adjustable armrests (a) rotates relative to the chair backrest (2), each arc-shaped convex block (a1) moves relative to the arc-shaped trajectory groove (23), the end of each of the angle adjustable armrests (a) defines a plurality of locking concavities (a2) arranged in a circumferential manner, the corresponding side of the chair backrest (2) further defines a transverse blind hole (24), and a locking ball (a3) is disposed on an opening of the transverse blind hole (24), a spring member (a4) is disposed in the transverse blind hole (24), an end of the spring member (a4) is abutted against a bottom of the transverse blind hole (24), the other end of the spring member (a4) is abutted against the locking ball (a3), and the spring member (a4) is configured to force at least a part of the locking ball (a3) to be stuck in any one of the plurality of locking concavities (a2).

20. The folding chair as claimed in claim 18, wherein the middle of the chair backrest (2) defines a plurality of locking grooves (25) sequentially connected from top to bottom, a cantilever slider (b1) is disposed on a rear side of the lumbar support (b), and the cantilever slider (b1) is slidably connected with the chair backrest (2) in a vertical direction, a locking part (b2) is disposed on the cantilever slider (b1), and the locking part (b2) is configured to be matched with any one of the plurality of locking grooves (25); and when the lumbar support (b) rises and falls under a vertical force, the locking part (b2) is separated from a current one of the plurality of locking grooves (25) to a next one of the plurality of locking grooves (25).

* * * * *